United States Patent [19]

Andersen et al.

[11] Patent Number: 4,701,114

[45] Date of Patent: Oct. 20, 1987

[54] COMPRESSOR SUCTION GAS HEAT SHIELD

[75] Inventors: Garry E. Andersen, La Crosse; James R. Quinn, Coon Valley; Peter J. Linnert, La Crosse, all of Wis.

[73] Assignee: American Standard Inc., New York, N.Y.

[21] Appl. No.: 889,042

[22] Filed: Jul. 25, 1986

[51] Int. Cl.[4] ..... F16L 59/00; F04B 39/12

[52] U.S. Cl. ..... 417/564; 417/373; 92/144

[58] Field of Search ..... 417/562–564, 417/902, 373; 285/368; 137/375; 92/144

[56] References Cited

U.S. PATENT DOCUMENTS

| | | | |
|---|---|---|---|
| 3,250,461 | 5/1966 | Parker | 417/902 |
| 3,817,661 | 6/1974 | Ingalls et al. | 417/312 |
| 3,926,009 | 12/1975 | Parker et al. | 62/296 |
| 3,971,407 | 7/1976 | Hudson et al. | 137/516.15 |
| 4,037,988 | 7/1977 | Goloff | 92/144 |
| 4,100,934 | 7/1978 | Butterworth et al. | 137/512 |
| 4,371,319 | 2/1983 | Murayama et al. | 417/312 |
| 4,382,749 | 5/1983 | Teegarden et al. | 417/295 |
| 4,411,600 | 10/1983 | Itagaki et al. | 417/312 |
| 4,549,857 | 10/1985 | Kropiwnicki | 417/902 |
| 4,573,881 | 4/1986 | Romer | 417/902 |

FOREIGN PATENT DOCUMENTS

| | | | |
|---|---|---|---|
| 2744759 | 4/1978 | Fed. Rep. of Germany | 417/559 |

*Primary Examiner*—William L. Freeh

*Attorney, Agent, or Firm*—William J. Beres; Carl M. Lewis; Robert J. Harter

[57] ABSTRACT

A combination heat shield/gasket is disposed between abutting components in a reciprocating compressor. The heat shield/gasket includes strategically located protuberances, at locations where the components do not directly abut, the tips of which contact one of the components causing the heat shield/gasket to locally deflect away from the contacted component. The deflection of the heat shield/gasket at such non-abutting locations causes a dead space to be created between the component contacted by the tip of the protuberance and the heat shield/gasket. The dead space so created is a barrier to the transfer of heat, as is the heat shield/gasket itself, from the component contacted by the protruberances to the area on the side of the heat shield/gasket opposite that side on which the dead space is created.

13 Claims, 9 Drawing Figures

COMPRESSOR SUCTION GAS HEAT SHIELD

BACKGROUND OF THE INVENTION

The present invention relates to preventing the direct exposure of relatively cool suction gas in a reciprocating compressor to compressor components heated by discharge gas.

The volumetric efficiency of a refrigeration compressor is directly affected by the temperature of the suction gas undergoing compression therein. Volumetric efficiency is the ratio of the actual weight of refrigerant compressed in a compressor cylinder, in operation, to the weight of the refrigerant the cylinder can theoretically hold. Suction gas is the relatively cool refrigerant vapor which is returned from the evaporator in a refrigeration system to the compressor. The actual volume and therefore the weight of the refrigerant vapor which flows into a compressor cylinder from an evaporator is always less than the theoretical volume of refrigerant which would flow into the cylinder if it were communicated to the cylinder at exactly the same temperature and pressure it left the evaporator.

Among the reasons the weight of the suction gas compressed in a compressor cylinder is less than the theoretical maximum is the fact that the walls of the compressor cylinder and other compressor components to which suction gas is exposed in its travel from the evaporator to the cylinder are considerably hotter than the refrigerant vapor received from the evaporator. As a result of its travel from the evaporator and past such heated components in the compressor suction gas flow path, suction gas temperature is increased prior to the start of the compression process. It follows then that the actual weight of the refrigerant delivered into the cylinder of a reciprocating compressor is less than the theoretical maximum weight due to the expanded volume of the refrigerant found in the cylinder prior to compression. The volumetric efficiency of the compressor suffers as a result.

The effect of such suction gas heating is particularly notable in the increasingly compact hermetic compressors currently being produced. In such compressors, wall thicknesses have been decreased and single walls are often used to define and separate two disticnt refrigerant flow paths within a compressor. Exemplary in this regard is the cylinder head illustrated in FIG. 2 of U.S. Pat. No. 3,817,661. Other illustrative patents are U.S. Pats. Nos. 3,926,009 and 3,971,407 in which suction gas is directly exposed to the compressor cylinder head assembly and U.S. Pats. Nos. 4,100,934; 4,382,749 and 4,411,600 in which the suction gas inlet passage is integral within the cylinder head/valve plate assembly.

Further, when suction gas is superheated the compression process is also affected from the standpoint of compressor energy consumption. This effect is a negative one and is one which causes the energy efficiency ration (EER) of the system in which the compressor is located to suffer. By reducing suction gas superheating the compression process becomes a more efficient one.

The problem of suction gas heating within a compressor is specifically addressed in U.S. Pats. Nos. 4,371,319; 4,411,600 and 4,549,857. U.S. Pat. No. 4,371,319 teaches an elaborate heat insulating arrangement in which compressor discharge components including the head cover, discharge silencer and discharge tube are coated by a heat insulating material. U.S. Pat. No. 4,411,600 teaches a plastic suction pipe by which suction gas is guided to a suction chamber. As earlier mentioned however, this patent nonetheless teaches the exposure of suction gas to high temperature compressor components in the immediate vicinity of the cylinder head assembly. Finally, U.S. Pat. No. 4,549,857 teaches a plastic suction inlet ad seal component in a compressor which is used in conjunction with a gasket for sound attenuation and suction gas insulating purposes. Suction gas is communicated into an internally molded suction chamber through dual inlet tubes in the inlet/seal component. The inlet/seal component and suction chamber surround the inlet openings of the valve plate assembly. The inlet/seal component is separated from the cylinder head by the aforementioned gasket.

As should be apparent from the number of recently-issued related patents, any manner in which suction gas heating can be minimized and the volumetric and/or energy efficiency of a refrigerant compressor increased, particularly at minimal expense and without unduly complicating the manufacture of the compressor, represents a significant advance in the compressor art.

SUMMARY OF THE INVENTION

It is a primary object of this invention to provide a space which is a barrier to the transfer of heat from a first machine part to a second machine part.

It is another object of this invention to provide a seal between abutting machine parts while providing a barrier to the transfer of heat between the parts at predetermined locations.

It is still another object of this invention to provide both a heat transfer barrier and a seal between abutting machine parts without unduly complicating or increasing the expense of manufacture of the machine.

It is a further object of this invention to minimize the superheating of suction gas in a refrigerant compressor so as to reduce compressor power consumption and therefore to provide for an improved compressor energy efficiency ratio (EER).

Finally, and most particularly, it is an object of this invention to increase the volumetric efficiency of a reciprocating refrigerant compressor by creating a space which is a barrier to the transfer of heat from a heated compressor component to suction gas traveling to a cylinder of the compressor.

Refrigerant gas is supplied to the cylinders of a reciprocating refrigerant compressor from the evaporator of the refrigerant system in which the compressor is employed. The path followed by the refrigerant between the evaporator and the compressor cylinders includes a suction passage which winds its way between and through compressor components. The present invention relates to a combination heat shield/gasket by which the suction gas passage in a reciproacting compressor is insulated from the cylinder head assembly which is heated by discharge gas.

In the compressor to which use of the present invention directly applies, the portion of the suction gas passage in the vicinity of the valve assembly inlet openings is exposed to cylinder head components heated by discharge gas. Such an arrangement is not uncommon in hermetic reciprocating compressors where, by necessity, suction gas enters and compressed gas exits the cylinder in the same vicinity, i.e., in the immediate area of the cylinder head. In many such compressors the cylinder head assemblies define at least a portion of the suction gas passage leading to the cylinders in the compressor's cylinder block.

The combination heat shield/gasket of the present invention operates as a seal between the block which defines the compressor's cylinders and a cylinder head assembly. However, where previous gaskets either left a portion of the inlet passage directly exposed to the hot cylinder head assembly or performed no heat insulating function whatsoever, the heat shield/gasket of the present invention includes protuberances spaced at one or more predetermined locations which force the heat shield/gasket away from contact with the cylinder head assembly in locations where the cylinder head assembly cooperates with the cylinder block to define the suction gas passage.

By forcing the heat shield/gasket away from the cylinder head assembly at such locations a dead space is created between the heat shield/gasket and the cylinder head assembly which acts as a barrier to the transfer of heat from the portion of the cylinder head assembly which overlies and partially defines the suction gas passage in the cylinder block. Additionally, the heat shield/gasket is coated so as to increase its ability to prevent the transfer of heat to the suction gas.

DESCRIPTION OF THE PREFERRED EMBODIMENT

Figure 1B:
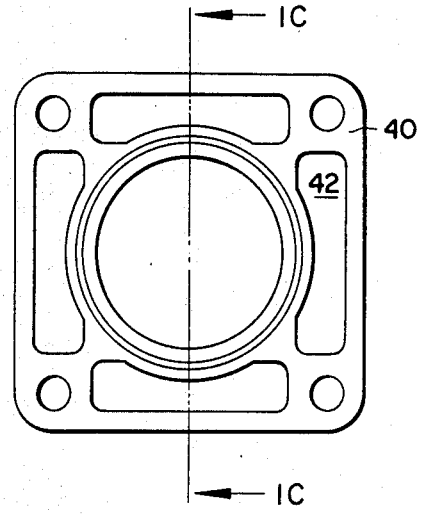
FIG. 1B (PRIOR ART)
FIGS. 1B and 1C illustrate the prior art gasket disposed between the cylinder block and head illustrated in FIG. 1A.
Figure 1C:
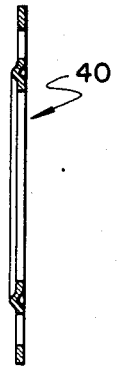
FIG. 1C (PRIOR ART)
Figure 1A:
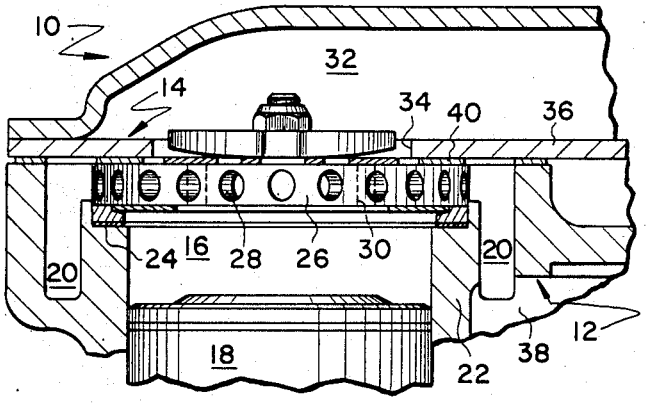
FIG. 1A (PRIOR ART)
FIG. 1A is a partial cross-sectional view of the cylinder block and head assembly of a prior art compressor.
Figure 2A:
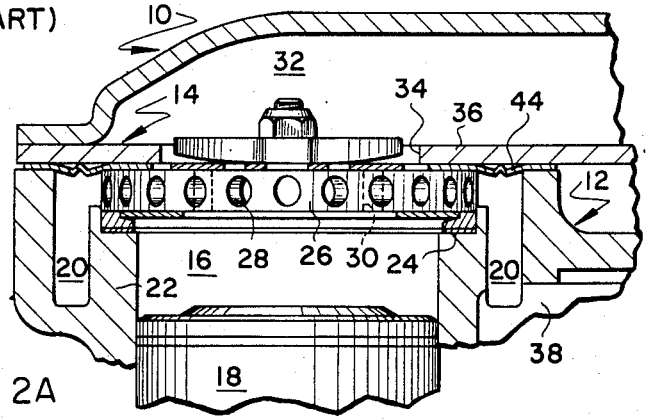
FIG. 2A is a partial cross-sectional view of the cylinder block and head portion of a compressor employing the combination heat shield/gasket of the present invention.
Figure 2B:
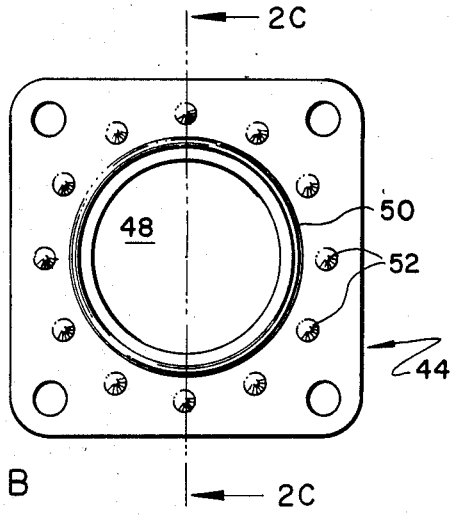
FIGS. 2B and 2C illustrate the combination heat shield/gasket of the present invention.
Figure 2C:
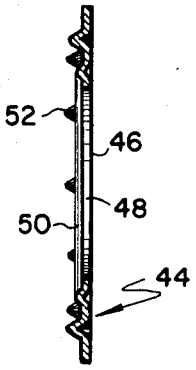

Referring initially to FIG. 1A there is illustrated a prior art reciprocating compressor arrangement 10 in which a conventional gasket is employed as a seal between the cylinder block 12 of the compressor and the cylinder head assembly 14. While cylinder block 12 and cylinder head assembly 14 are components of a reciprocating compressor in the preferred embodiment, the invention likewise is applicable to any adjacent machine parts having complementary planar surfaces which mate under the circumstances herein described. In the arrangement of FIG. 1A, cylinder block 12 defines cylinder 16 in which a reciprocating piston 18 is disposed. Cylinder block 12 also defines a suction plenum 20 which is a void that surrounds cylinder wall 22 of block 12. Cylinder wall 22 defines a seat 24 which accommodates valve assembly 26. Valve assembly 26 includes inlet ports 28 around its periphery through which suction gas is admitted to cylinder 16 from suction plenum 20. Discharge ports 30 pass through the valve assembly and allow for the discharge of compressed gas from cylinder 16 into the interior 32 of cylinder head assembly 14. The individual suction and discharge valves associated with assembly 14 are not shown.

Cylinder head assembly 14 defines an opening 34 which overlies the discharge ports 30 of the valve assembly 26. Valve assembly 26 is disposed between cylinder block 12 and cylinder head assembly 14 and operates such that as piston 18 moves away from valve assembly 26 suction gas is drawn into cylinder 16 through valve assembly inlet ports 28 from suction gas plenum 20. When piston 18 moves toward valve assembly 26 compressed gas is discharged into interior 32 of the cylinder head assembly through discharge ports 30 of the valve assembly. It will be seen in FIG. 1A that wall portion 36 of the cylinder head assembly overlies suction plenum 20 of cylinder block 12 so that suction gas entering suction plenum 20 from suction passage 38 is exposed to wall portion 36.

Disposed between valve assembly 26, block 12 and cylinder head assembly 14 is a gasket 40 which is best illustrated in FIGS. 1B and 1C. Gasket 40, as is conventional, defines cutouts 42 which are located in areas of non-contact between otherwise gasketed components such as where cylinder head assembly 14 overlies suction plenum 20 of the cylinder block. Because gasket 40 is of conventional design, suction gas in suction plenum 20 is directly exposed to cylinder head wall portion 36 where wall portion 36 overlies the suction plenum. Wall portion 36 of the cylinder head assembly is heated by the compressed gas discharged into the interior 32 of the cylinder head assembly from cylinder 16. Whereas suction gas temperature is generally on the order of 60° F., the compressed gas discharged into the cylinder head assembly is heated to approximately 215° F. by the compression process. For the reasons discussed above, such exposure and the heating of the suction gas which results in disadvantageous to both the volumetric efficiency of the compressor as well as its overall energy efficiency ratio.

Figure 3:
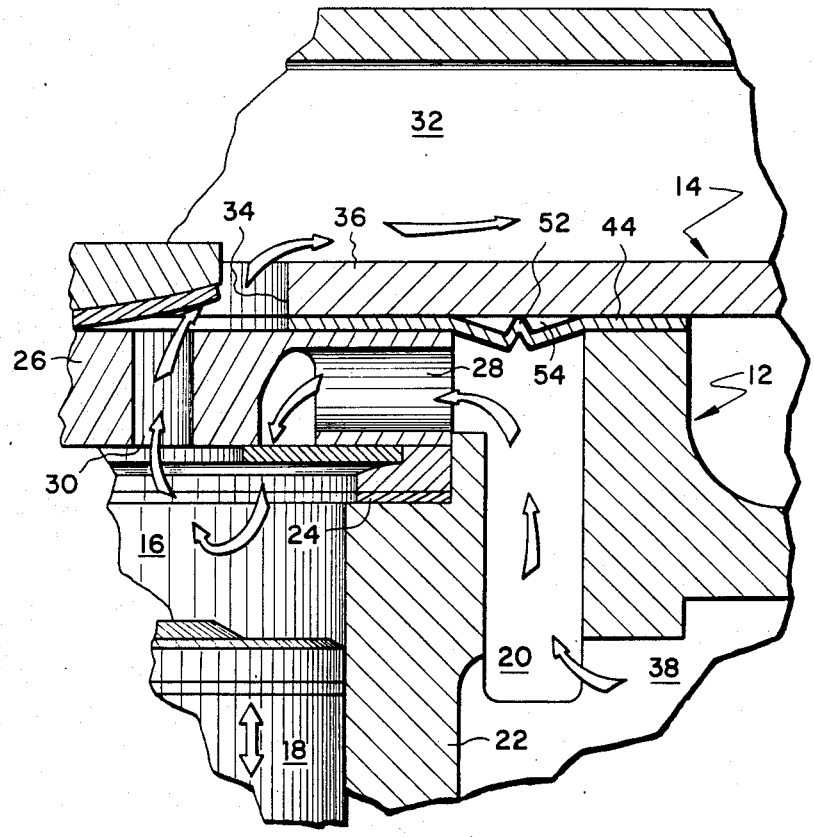
FIG. 3 is an enlarged view of the suction plenum area of FIG. 2A and illustrates the flow of gas in the vicinity of the valve assembly.
Figure 4:
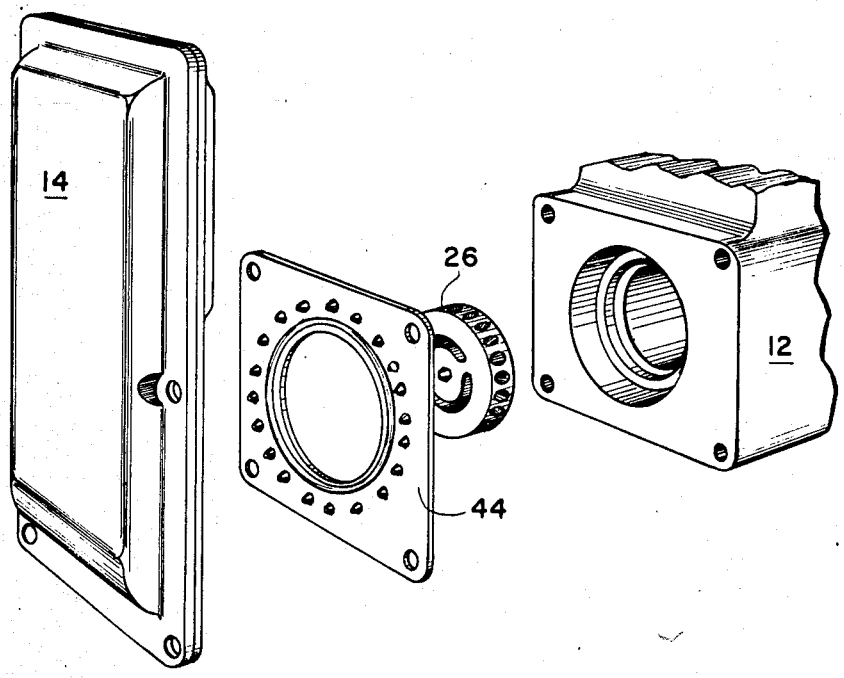
FIG. 4 is an exploded view of the compressor of FIG. 2A.

Referring now to FIGS. 2A, 2B, 2C, 3 and 4, in which elements identical to the numbered elements in FIG. 1 are numbered as in FIG. 1, a heat shield/gasket 44 is illustrated the employment of which accomplishes the sealing function of gasket 40 of FIG. 1 but which further, in cooperation with cylinder head wall portion 36, acts to create a barrier to the transfer of heat from the cylinder head assembly to the suction gas in suction plenum 20. Heat shield/gasket 44 is preferably coated with a layer 46 of heat insulating material such as rubber. Depending upon the particular application heat shield/gasket might be coated on both sides, one side or not at all. An opening 48 is defined by the heat shield/gasket which does not interfere with the discharge of compressed gas into the interior 32 of the cylinder head assembly from discharge ports 30 of the valve assembly yet which is sized so that a portion of the heat shield/gasket overlies the peripheral edge of the valve assembly. As is best illustrated in FIG. 3, that portion of the gasket which overlies the edge of the valve assembly is trapped between the peripheral edge of the valve assembly and wall portion 36 of the cylinder head assembly to create a seal therebetween. It is this portion of the gasket which includes a raised lip 50 which is compressed between the valve assembly and cylinder head assembly when the two components are attached so as to insure the creation of a tight seal between the components at that location.

Unique to heat shield/gasket 44 are protuberances 52 which are located at predetermined strategic locations on the heat shield. Protuberances 52 are located at positions where, when heat shield/gasket 44 is disposed between the compressor components it serves to seal and separate, their tips contact one of the components causing the heat shield/gasket to deflect away from the contacted component in the vicinity of each protuberance due to the lack of an opposing surface on the second or non-contacted component. Thus, protuberances 52 are located on heat shield/gasket 44 in areas where no conventional gasket material would otherwise be found, i.e., in areas of non-contact between the surfaces of abutting otherwise gasketed components. These areas, in the preferred embodiment, are represented by the areas of cutouts 42 in the conventional gasket illustrated in FIG. 1B which overlie the void that is suction plenum 20 when the gasket is disposed between the cylinder head assembly and cylinder block. In effect then, protuberances 52 serve a purpose entirely foreign to the sealing purpose of a conventional gasket. That is, they serve to force heat shield/gasket 44 away from contact with the surface of a component and to create a dead space between the heat shield/gasket and the adjacent component at predetermined locations.

In the reciprocating compressor of the present invention, as illustrated in FIG. 3, one such area of non-contact between gasketed components is plenum area 20 which is defined by cylinder block 12. By virture of the contact the tips of protuberance 52 with cylinder head wall portion 36, heat shield/gasket 44 is locally forced away from contact with the hot wall portion 36 of the cylinder head assembly. A dead space 54 is therefore created between the heat shield/gasket and the cylinder head assembly. It will be appreciated that such a space is an effective barrier to the transfer of heat from the cylinder head assembly to the relatively cool suction has which passes through suction plenum 20 and into valve assembly ports 28. Whereas prior art compressors often unnecessarily allowed for the direct contact of suction gas with a heated component or ignored the transfer of heat by conduction through a gasket which directly contacted a heated component to the void beneath it, the compressor of the present invention does not. It will be further appreciated that both coating 46 and gasket 44 act as further impediments to the transfer of heat. These multiple impediments to heat transfer result in a measurable increase in the volumetric and pumping efficiency of a refrigerant gas compressor at essentially no cost.

In general, it will be apparent that the distal ends or tips of protuberances 52 are oriented in a direction so that they contact and force the heat shield away from the hotter of the separated components although dead space 54 would be equally effective as a barrier to the transfer of heat from the void beneath the gasket, i.e., plenum 20, to the component contacted by the protuberance tips if the void temperature were higher. It should be further noted that the height of protuberances 52 is predetermined so as to cause sufficient deflection of the heat shield away from the component contacted by the protuberances to create a dead space between the contacted component and the heat shield. The tips of protuberances 52 may be rounded or flattened to avoid the development of local hot spots at the protuberance tips by allowing for a greater area of contact between the protuberances and the contracted component part.

While in the embodiment of FIG. 2 protuberances 52 are illustrated as being discrete conically shaped entities, it will be appreciated that the protruberances need not be conical nor discontinuous. In this respect, the protruberances FIG. 2 could be joined so as to form a continuous raised portion or several discrete raised portions on the heat shield/gasket. Further, heat shield/gasket 44 might be a formed piece such that upon being disposed between the cylinder block and cylinder head assembly it cooperates with the cylinder head assembly to define a dead space without contact between the heat shield/gasket and the cylinder head assembly where the cylinder head assembly overlies the suction plenum.

Figure 5:
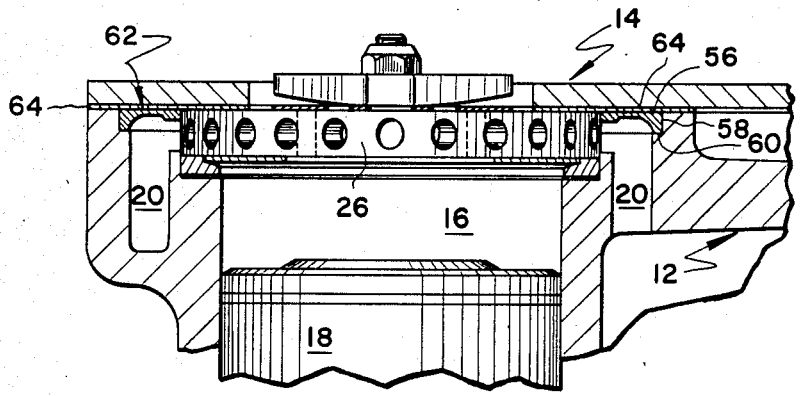
FIG. 5 illustrates an alternative heat shield arrangement.

An alternative to the preferred embodiment of FIG. 1 is the heat shield arrangement of FIG. 5 in which a discrete heat transfer shield 56 is employed in conjunction with a conventional gasket. Once again, components identified by the same numbers in FIG. 5 as in the other figures are identical to the components illustrated in the other figures. Heat shield 56 of FIG. 5 is an annular ring manufactured from a heat insulating material and having a cross section which is somewhat L-shaped but rotated 90°. The foot portion 58 of heat shield 56 is accommodated in groove 60 which is machined into cylinder block 12. The back portion 62 of heat shield 56 is biased away from an exact 90° relationship with foot portion 58 so that the heat shield is biased similarly to a Belleville spring. As a result, when heat shield 56 is inserted into grooves 60, as is illustrated, back portion 62 is raised above the plane of the top of valve assembly 26. Therefore, when cylinder head assembly 14, to which conventional gasket 64 is attached, is itself attached to cylinder block 12, back portion 62 of heat shield 56 is depressed and becomes tightly ensconced between cylinder head assembly 14 and suction plenum 20. Gasket 64 may be identical to gasket 40 of FIG. 1 in which case a void would be created between heat shield 56 and cylinder head assembly 14. Gasket 64 might also be a solid gasket without the cutouts 42 illustrated in FIG. 1B. By reason of the need for a machined groove and the fact that two discrete components, i.e., a separate gasket and heat shield, are required to accomplish the same purpose of the heat shield/gasket of FIG. 2, the embodiment of FIG. 2 is preferred.

While the heat shield/gasket of the present invention has been described in the context of a reciprocating refrigerant gas compressor, it should be entirely apparent that the use of the invention is advantageous in any equipment wherein the imposition of a heat transfer barrier between non-abutting portions of otherwise abutting gasketed components is desirable. Therefore, the invention should not be construed as being limited other than by the language of the claims which follow.

What is claimed is:

1. Aparatus in a refrigeration compressor comprising:

a cylinder block having a surface in which a void is defined;

a cylinder head assembly having a surface at least partially abutting said surface of said cylinder block, said abutting surface of said cylinder head assembly including an area which overlies said void in said surface of said cylinder block, said overlying area of said cylinder head assembly being at a temperature higher than the temperature in said void in said first machine part when said machine is in operation; and unitary means, disposed between said cylinder block and said cylinder head assembly, for both defining a dead space, in cooperation with said cylinder head assembly, between said void in said cylinder block and said overlying area in said cylinder head assembly and for providing a seal between the directly abutting surfaces of said cylinder block and said cylinder head assembly.

2. The apparatus according to claim 1 wherein said means for creating a dead space and providing a seal comprises a heat shield/gasket disposed between said cylinder block and said cylinder head assembly, said heat shield/gasket having at least one protuberance which contacts said overlying area of said cylinder head assembly so that said heat shield/gasket is deflected away from said overlying area of said cylinder head assembly to create said dead space.

3. The apparatus according to claim 2 wherein said overlying area of said cylinder head assembly and said void in said cylinder block cooperate to define a suction passage in flow communication with the cylinder in said cylinder block.

4. The apparatus according to claim 3 wherein a valve assembly is disposed in a seat in said cylinder block, said valve assembly for providing an inlet passage from said suction passage to a cylinder defined by said cylinder block and a discharge passage from said cylinder into said cylinder head assembly, said heat shield/gasket providing a seal between said valve assembly and said cylinder head assembly and between said cylinder head assembly and said cylinder block whereby gas passing through said suction passage into said cylinder is insulated from said cylinder head assembly by said dead space formed between said heat shield/gasket and said cylinder head assembly.

5. The apparatus according to claim 4 wherein said heat shield/gasket is coated with a heat insulating material.

6. The apparatus according to claim 4 wherein said at least one protruberance is conical.

7. Apparatus for reducing the transfer of heat to suction gas interior of a reciprocating compressor comprising:

a cylinder block having a planar surface in which a suction gas passage is at least partially defined;

a cylinder head assembly attached to said cylinder block and having a complementary planar surface, said complementary surface mating with said planar surface of said cylinder block and overlying said suction gas passage therein; and unitary means, disposed between said planar surface and said complementary surface, both for providing both a seal between said planar and said complementary surfaces and for defining a dead space which is a barrier to the transfer of heat from said cylinder head assembly to said suction gas passage in the planar surface of said cylinder block.

8. The compressor according to claim 7 wherein said means for providing both a seal and a space comprises a heat shield/gasket having at least one protuberance, the distal end of said protuberance contacting said cylinder head assembly where said assembly overlies said suction gas passage so that said heat shield/gasket is deflected away from said cylinder head assembly into said suction gas passage, whereby a space is created between said suction gas passage and said cylinder head assembly.

9. The compressor according to claim 8 wherein said heat shield/gasket is coated with a heat insulating material.

10. The compressor according to claim 8 wherein said at least one protruberance is conical.

11. Apparatus in a refrigeration compressor for creating both a seal and a barrier to the transfer of heat between first and second compressor parts each of which has a planar mating surface, where the mating surface of the first compressor part has a void which is overlain by the mating surface of the second compressor part, comprising:

a unitary combination heat shield/gasket disposed between the mating surfaces of said first and second compressor parts, said heat shield/gasket having at least one protruberance, the distal end of said protruberance contacting the mating surface of said second compressor part at a location where said second machine part overlies the void in said first machine part, the contact of said distal end of said protruberance with said second compressor part causing said heat shield/gasket to deflect away from said second compressor part and into the void in said first compressor part, whereby a dead space is created between said heat shield/gasket and said second compressor part where said second compressor part overlies the void in said first compressor part.

12. The apparatus according to claim 11 wherein at least one surface of said heat shield/gasket is coated with a heat insulating material.

13. The apparatus according to claim 12 wherein said at least one protruberance is conically shaped.

* * * * *